US007134609B1

(12) United States Patent
Stouffer et al.

(10) Patent No.: US 7,134,609 B1
(45) Date of Patent: Nov. 14, 2006

(54) FLUIDIC OSCILLATOR AND METHOD

(75) Inventors: Ronald D. Stouffer, Silver Spring, MD (US); Aland Santamarina, Columbia, MD (US)

(73) Assignee: Bowles Fluidics Corporation

( * ) Notice: Subject to any disclaimer, the term of this patent is extended or adjusted under 35 U.S.C. 154(b) by 155 days.

(21) Appl. No.: 10/844,595

(22) Filed: May 13, 2004

Related U.S. Application Data

(60) Provisional application No. 60/470,492, filed on May 15, 2003.

(51) Int. Cl.
*B05B 3/00* (2006.01)
*B05B 1/08* (2006.01)
*B05B 15/08* (2006.01)
*B05B 1/14* (2006.01)

(52) U.S. Cl. ..... 239/225.1; 239/102.1; 239/102.2; 239/589.1; 239/590.5

(58) Field of Classification Search ..... 239/225.1, 239/102.1, 102.2, 589.1, 590.5, 597, 593, 239/554
See application file for complete search history.

(56) References Cited

U.S. PATENT DOCUMENTS 4,151,955 A 5/1979 Stouffer ..... 239/11
4,184,636 A 1/1980 Bauer ..... 239/11
RE33,159 E * 2/1990 Bauer
RE33,448 E * 11/1990 Bauer
RE33,605 E * 6/1991 Bauer
5,396,808 A 3/1995 Huang et al.
5,638,867 A 6/1997 Huang

* cited by examiner

*Primary Examiner*—Davis Hwu
(74) *Attorney, Agent, or Firm*—Jim Zegeer

(57) ABSTRACT

An oscillating spray device comprising an oscillation chamber. A power nozzle for projecting a jet of liquid under pressure into the oscillation chamber in a given direction. A reversing member in the chamber has a reversing wall for reversing the direction of flow of the fluid jet in a direction 180° opposite the given direction. A system of vortices is formed thereby for alternately passing fluid to one side or the other of the reversing member. A pair of passages, one on each side of the reversing member, convey alternate pulses of fluid through the passageways in the given direction past the reversing member to an outlet to ambient, and an island barrier positioned in the outlet to ambient and forming two separate passageways to the outlet and a third passageway between the reversing member and the island barrier. The spray characteristics can be adjusted by changing the spacing between the reversing member and island barrier.

6 Claims, 7 Drawing Sheets

Section A-A $$Ar = \frac{depth}{width}$$

Graph 1

Section A-A

FLUIDIC OSCILLATOR AND METHOD

REFERENCE TO RELATED APPLICATION

The present application is the subject of provisional application No. 60/470,492 filed May 15, 2003 and entitled REVERSE-REVERSING CHAMBER OSCILLATING NOZZLE.

BACKGROUND AND BRIEF DESCRIPTION OF THE INVENTION

The present invention relates to improvements in fluidic oscillators and novel spray-forming output structures for fluidic oscillators.

In Bauer U.S. Pat. No. 4,184,636, a fluidic oscillator is disclosed which includes a chamber having a common inlet and outlet opening for which the fluid power jet is issued across the chamber. The jet impinges on a reversing wall and splits and turns so that each turned half exits through an opposite outlet port. This flow pattern contains two oppositely rotating vortices and is inherently unstable in that any small dissimilarity in the flow will abet one side while deterring the other side so that one vortex dominates the opposite or other vortex to the point where all the flow exits the one output side and the other vortex completely blocks the other output. This pattern is short lived because one vortex, being forced close to the power jet, receives fluid having higher energy than the opposite vortex. The pair of outputs was fed to an output chamber which issues a sweeping spray that was determined by the algebraic sum of two inflow components.

Stouffer U.S. Pat. No. 4,151,955 is another species of fluidic oscillator which is devoid of external feedback. In this patent, an island produces a vortex street which is shed downstream of the island or obstacle. As disclosed in this patent, various spray patterns can be generated by varying the output geometry. As disclosed in this patent, a second island may be provided in the outlet to split the output as well to control the air infiltration.

THE PRESENT INVENTION

According to the present invention, a fluidic oscillator is provided for issuing a soft, full-coverage spray with large liquid droplets upon a work surface. The fluidic oscillator nozzle comprises an oscillation chamber and a power nozzle for projecting a jet of liquid into the oscillation chamber. A U-shaped reversing member provides the fundamental oscillating function of the device. A pair of liquid flow passages formed on each side of the U-shaped reversing member provides liquid reversing flow paths through which periodic pulses of liquid alternately pass. In a preferred embodiment of the invention, an island barrier downstream of the U-shaped reversing member is provided in the outlet so that chamber issues a soft, full-coverage spray with large liquid droplets upon a work surface.

BRIEF DESCRIPTION OF THE DRAWINGS

The above and other objects, advantages and features of the invention will become more apparent when considered with the accompanying specification and attached drawings wherein.

DETAILED DESCRIPTION OF THE INVENTION

Figure 1A:
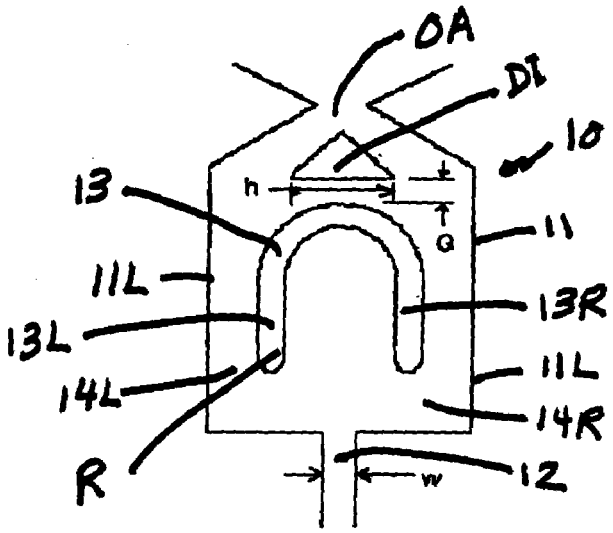
FIG. 1A is a schematic diagram of a preferred embodiment of the invention.

Referring now to FIG. 1A, a fluidic oscillator 10 incorporating the invention is shown in silhouette form and incorporates an oscillation chamber 11 having a power nozzle 12 with a width W. The power nozzle 12 projects a jet of liquid into the oscillation chamber 11. A U-shaped reversing member 13 has its legs 13L and 13R spaced from the sidewalls 11L, 11R. The radius R of the legs 13L and 13R of U-shaped reversing member 13 is such as to not impede the reversing output flows to passageways 14R and 14L (see FIG. 4D). The design as illustrated is such as to preclude the formation of a counteracting vortex which would stop the oscillation. It has been found that providing a generous space for the turning or reversing radius R while properly sizing the cross-section of the passageways 14L, 14R does not impede the oscillation.

Figure 4A:
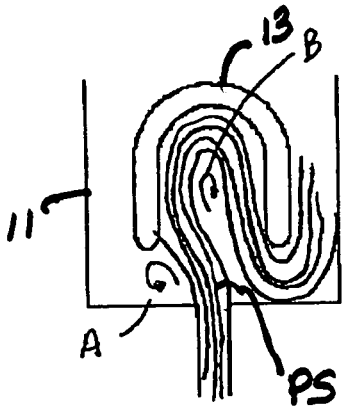
Figure 4B:
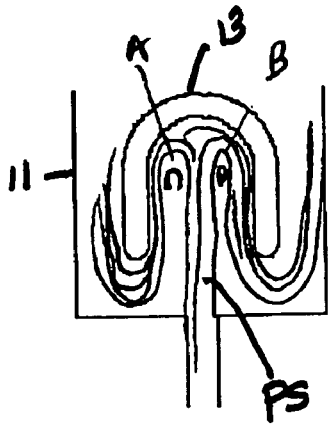
Figure 4C:
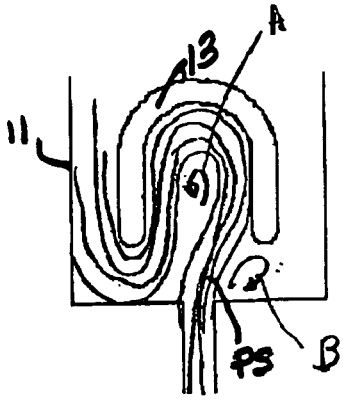
Figure 4D:
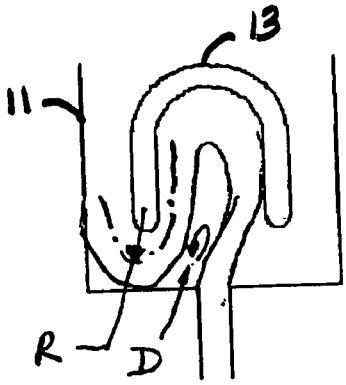

The oscillation operating mechanism is illustrated in FIGS. 4A, 4B and 4C which are progressive stages of the cycle. FIG. 4A shows the oscillator in one extreme where the vortex A is blocking the left output and the vortex B is centrally located in the interaction chamber. At this point, vortex B is weakening as it is now relatively remote to the high energy part of the power stream while vortex A is gaining strength since it is very close to the power stream PS. FIG. 4B shows the vortex A as expanded and moved to a more central position in the reversing member 13 beside the decaying vortex B.

FIG. 4C shows vortex A in the central chamber position and the weakening vortex B blocking the right output. Vortex B then picks up energy from the power stream and the cycle continues. In the initial state, which is proximately illustrated in FIG. 4B, the power jet impinges on the reversing member. The impinging jet is divided into two flows which follow the contours of reversing member 13 and output passages 14L and 14R. This condition is highly unstable, and one of the vortexes A or B predominates to result in the oscillation sequences described earlier herein.

Figure 3:
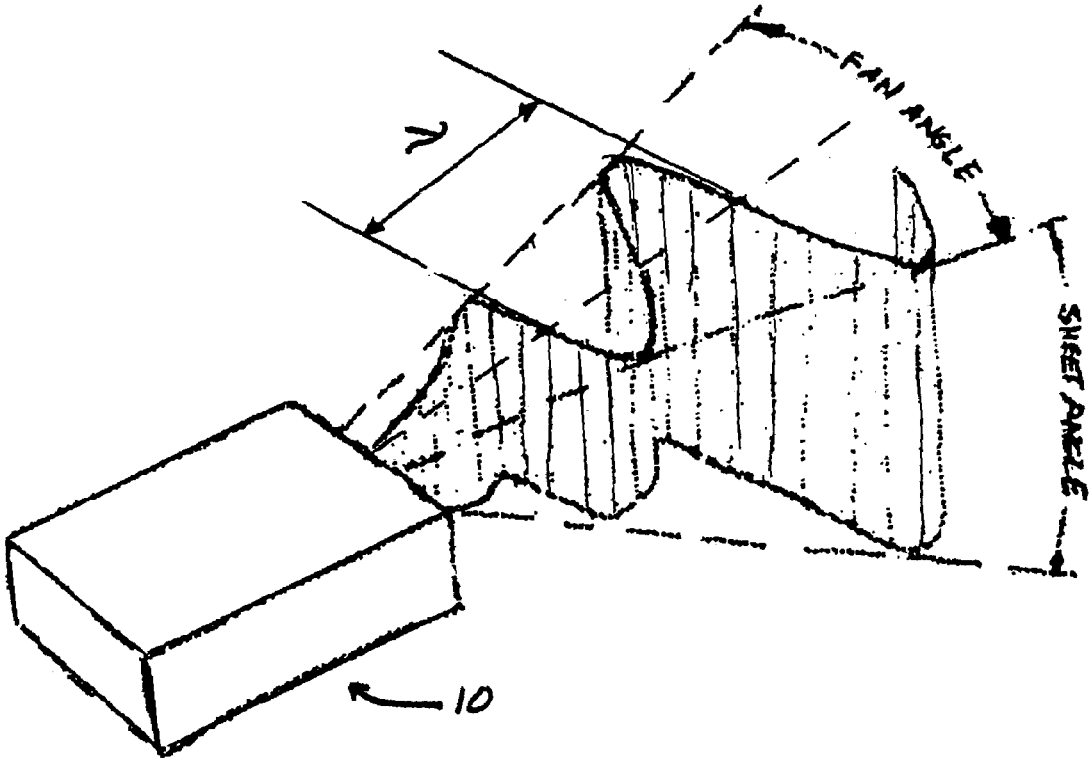
FIG. 3 is a isometric view illustrating the spray output from the fluidic oscillator incorporating the embodiment shown in FIG. 1A, FIGS. 4A, 4B, 4C and 4D are diagrammatic illustrations used for explaining the basic functioning of the fluid oscillator.

The velocity of the spray was in the lower range and the droplets were fairly large. The coverage was 55° in the oscillation plane (the "fan angle") and 45° in the thickness plane. This provides ideal droplet sizes for decontamination applications and in all applications where a full-coverage spray with low exit velocity is desired. As shown in FIG. 3, there are two spray planes when dealing with full-coverage sprays. First, the fan plane ("fan angle") entirely contains the oscillation and is easily viewed from above the circuit. Secondly, the thickness plane ("sheet angle") is perpendicular to the fan angle through its center spray. It is obvious that by controlling the fan angle and/or the sheet angle that the coverage area (fan and thickness angles) and output velocity, the size and shape of the coverage area can be controlled.

Figure 1B:
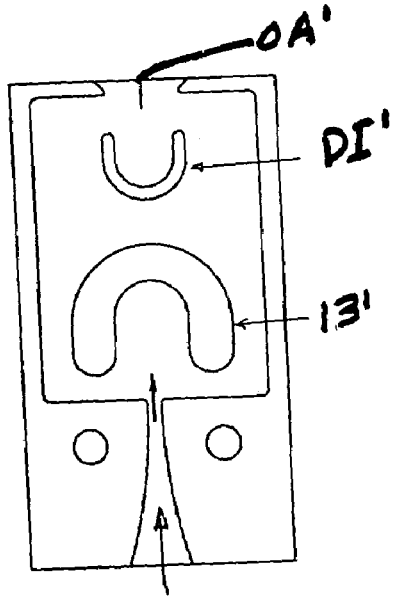
FIG. 1B is an embodiment with an arc-shaped island.
Figure 6A:
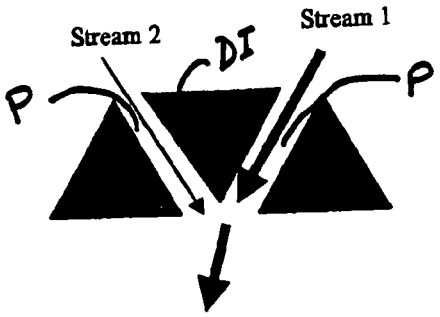
FIG. 6A is a diagrammatic illustration of the flow path around the island.
Figure 6B:
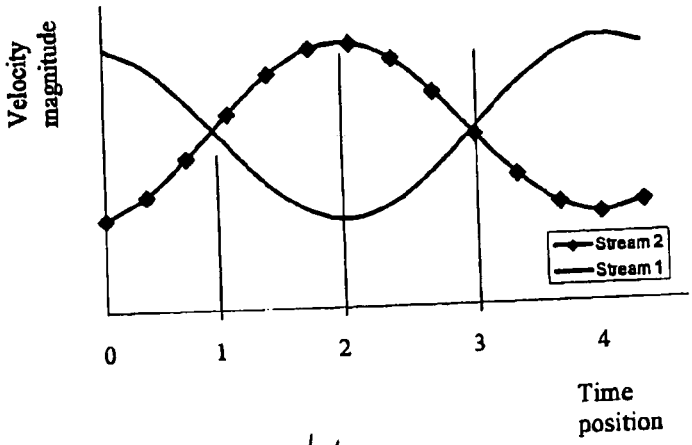
FIG. 6B is a graph of velocity magnitude versus time position of the two outputs shown in FIG. 6A.
Figure 7:
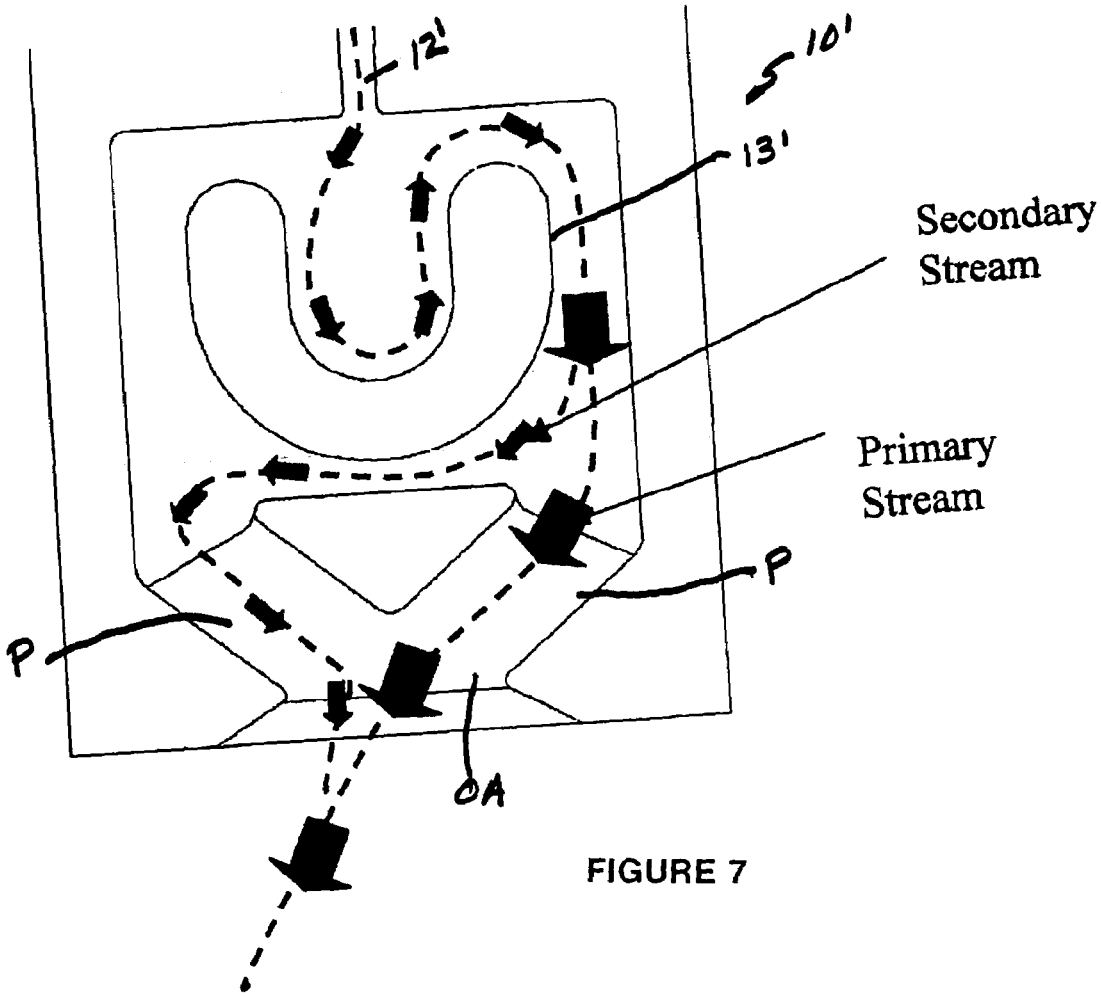
FIG. 7 is a diagrammatic illustration of the flow path in one instant of time in the preferred embodiment of the invention.
Figure 8A:
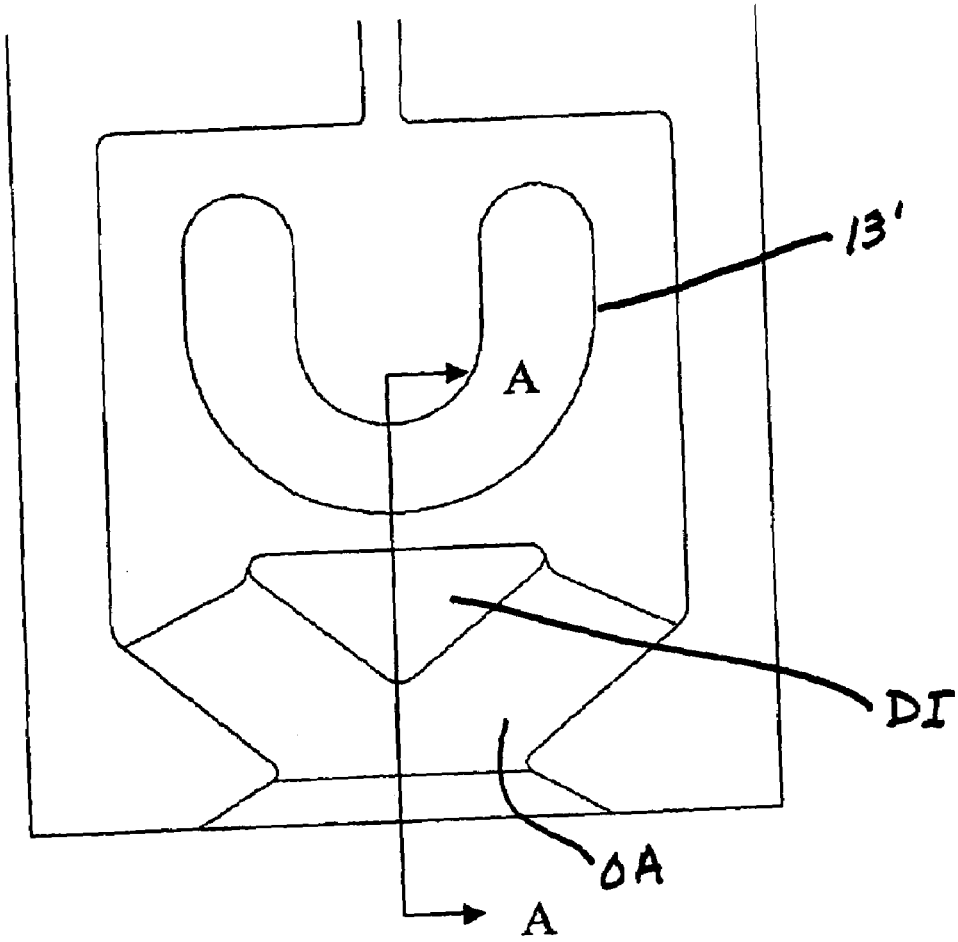
FIG. 8A is a diagrammatic illustration of the preferred embodiment of the invention.
Figure 8B:
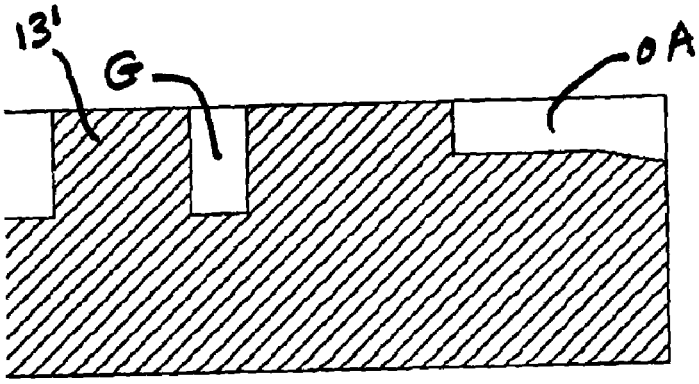
FIG. 8B is a section taken through line A—A of FIG. 8A.

In the preferred embodiment, the output is controlled by a downstream island DI in output area OA. The downstream island can be an arc (FIG. 1B), a flat plate, round or triangular, as shown in FIGS. 1A, 5A, 7 and 8A. The shape has little impact on the spray characteristic. One critical dimension was found to be the width of the channel G between the downstream island DI and the U-shaped reversing member 13. As the width is reduced, the spray thickness decreases and the fan increases (see Table 1 below). This behavior is consistent with the collision of two oscillating streams near the exit (see FIGS. 6A and 7). Referring to FIG. 6A, if stream 1 is at some velocity V1 and "Stream 2" is at some velocity V2, where the magnitude of V1 and V2 are governed by the functions shown in Graph 1 (FIG. 6B), then a collision of minimum magnitude will occur at time positions 0 and 2 (the edge of the spray), and maximum magnitude will occur at time point 1 (the center of the spray). In fact, what is occurring when the width of channel "G" is reduced is a decrease in the magnitude of the secondary stream because its passage has been restricted by "G". Thus, the energy of the collision is reduced and so is the thickness of the spray. By conservation of momentum, the weaker secondary stream has less effect on the primary steam therefore increasing the fan angle. By this reasoning, if the secondary stream was eliminated, then we expect the spray to be 2D with the largest possible fan angle; and, this is precisely what occurred when channel "G" was blocked. Thus, the role of island "I" is to establish a secondary stream that will collide near the exit of the nozzle creating a thick waving flag (FIG. 3). Channel "G" gives us a degree of control over the distribution, fan and thickness angles, independent from the oscillator.

Figure 5A:
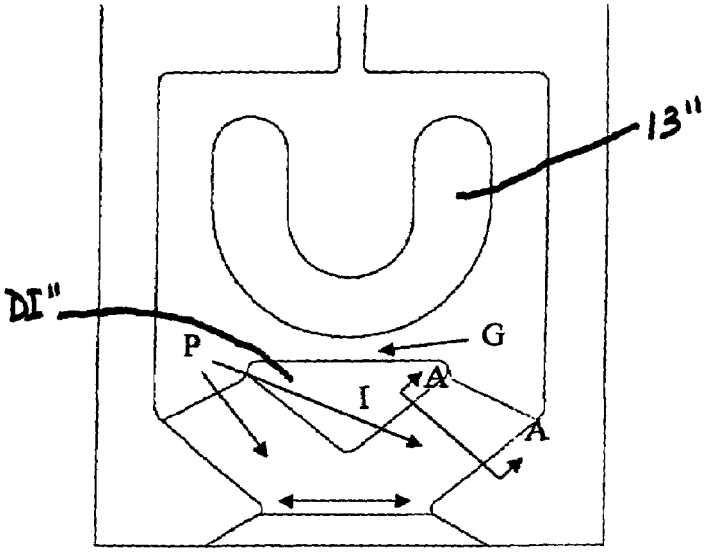
FIG. 5A is a partial silhouette of a preferred embodiment of the invention.
Figure 5B:
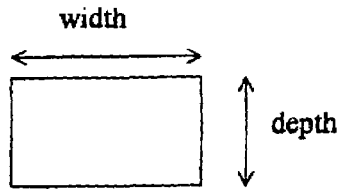
FIG. 5B is a cross-section through passage section lines A—A of FIG. 5A.

A feature of the invention relates to the aspect ratio (Ar) of the two streams (channels "P", FIG. 5). Experiments of two steady-state streams in channels with various Ar's demonstrated that ratios less than 0.5 generated superior distribution in the thickness plane. It turns out that a ratio of $Ar \leqq 0.25$ avoids center-heavy spray issues and creates a spray with visually uniform distribution in both planes. This feature can be used with other types of fluidic oscillators.

The following spray characteristics of the oscillator with shift of the downstream island is set forth in the following Table 1:

| With downstream island | | | | |
|---|---|---|---|---|
| G | Fan Angle | Sheet Angle | λ | waveform |
| Small < 1 w | large | small | constant | heavy ended |
| Medium ≈ 1 w | medium | medium | constant | sinusoidal |
| Large > 1 w | small | large | constant | triangular |

Figure 2:
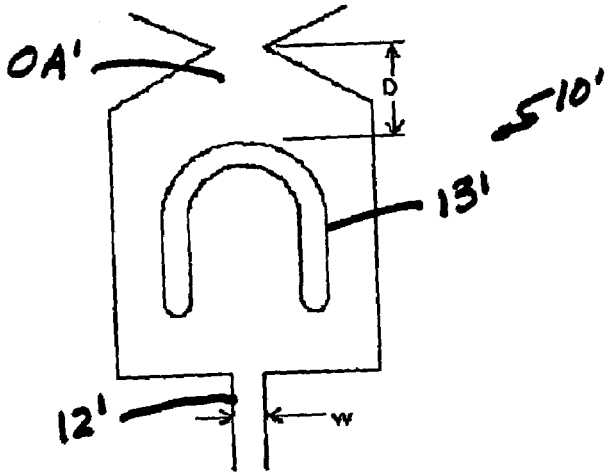
FIG. 2 is a further embodiment of the invention without the island.

Without the downstream island as shown in FIG. 2, the following matrix provides a synopsis of the output parameters (Table 2):

| Without downstream island | | | | |
|---|---|---|---|---|
| D | Fan Angle | Sheet Angle | λ | Waveform |
| Large > 10 w | smaller | larger | constant | triangular |
| Small < 10 w | large | small | constant | Heavy ended |

Thus, the fundamental oscillator design permits the designer to change certain of the performance parameters by changing the internal geometry without disturbing the other performance parameters. In other words, the parameters of the influence are less cross-coupled than with other fluidic oscillators, thereby facilitating the design of the oscillators to reach specific coverage requirements.

While the invention has been described in relation to preferred embodiments of the invention, it will be appreciated that other embodiments, adaptations and modifications of the invention will be apparent to those skilled in the art.

What is claimed is:

1. A fluidic oscillator nozzle comprising:

an oscillation chamber having a power nozzle for projecting a jet of liquid into said oscillation chamber, a U-shaped reversing member with an open part, said open part facing said power nozzle, a pair of liquid flow passages to each side of said U-shaped reversing member through which pulses of liquid alternately pass, an outlet from said chamber for issuing a soft, full-coverage spray with large liquid droplets upon a work surface and an island barrier spaced a distance "G" downstream of said U-shaped reversing member and forming a pair of output flow passages to said outlet, said pair of output flow passages have an aspect ratio Ar of about 0.25 or less.

2. A method of adjusting the spray characteristics of a fluidic nozzle having an oscillation chamber, a U-shaped reversing member in said oscillation chamber into which said liquid jet is issued, and a pair of passages to each side of said U-shaped reversing member for passing periodic pulses of liquid from said reversing member to a downstream outlet, an island barrier in said downstream outlet, said island barrier being spaced a distance "G" downstream of said reversing member, the method comprising adjusting the distance "G" between said U-shaped reversing member and said downstream island barrier to couple more or less liquid from one side of said island member to the other side of said island member.

3. An oscillating spray device comprising an oscillation chamber, means for projecting a jet of liquid under pressure into said oscillation chamber in a given direction, a reversing member in said chamber having a reversing wall for reversing the direction of flow of said fluid jet in a direction 180° opposite said given direction, a system of vortices being formed thereby for alternately passing fluid to one side or the other of said reversing member, a pair of passageways, one on each side of said reversing member, for conveying alternate pulses of fluid through said passageways in said given direction past said reversing member, an outlet to ambient, and an island barrier member positioned in said outlet to ambient to form two separate output channels to said outlet and a third passageway between said reversing member and said island barrier.

4. The oscillating spray device defined in claim 3 wherein liquid flowing through one of said pair of passageways is diverted in said third passageway between said U-shaped reversing member and said island to the opposite side thereof.

5. The oscillating spray device defined in claim 3 wherein said output channels have an aspect ratio of about 0.25 or less.

6. In a liquid spray device having an upstream fluidic oscillator providing a pair of liquid flow passages through which pulses of liquid alternately flow to a common spray outlet to ambient, the improvement comprising an island barrier forming a pair of output flow passages to said common spray outlet and wherein said pair of output flow passages have an aspect ratio Ar of about 0.25 or less to avoid center-heavy spray issues and creates a spray with substantially uniform distribution in two planes which are transverse to each other.

* * * * *